US007648746B2

(12) United States Patent
Tomotake et al.

(10) Patent No.: US 7,648,746 B2
(45) Date of Patent: Jan. 19, 2010

(54) INK JET RECORDING PAPER

(75) Inventors: Yoshiaki Tomotake, Sunto-gun (JP); Naoko Mouri, Sunto-gun (JP)

(73) Assignee: Tokushu Paper MFG. Co., Ltd., Shizuoka (JP)

( * ) Notice: Subject to any disclaimer, the term of this patent is extended or adjusted under 35 U.S.C. 154(b) by 352 days.

(21) Appl. No.: 11/647,205

(22) Filed: Dec. 29, 2006

(65) Prior Publication Data

US 2007/0110926 A1 May 17, 2007

Related U.S. Application Data

(62) Division of application No. 09/673,217, filed as application No. PCT/JP00/01055 on Feb. 24, 2000, now abandoned.

(30) Foreign Application Priority Data

| | | |
|---|---|---|
| Mar. 5, 1999 | (JP) | ..... 11-57793 |
| Dec. 16, 1999 | (JP) | ..... 11-356916 |
| Feb. 14, 2000 | (JP) | ..... 2000-34849 |

(51) Int. Cl.
*B41M 5/40* (2006.01)

(52) U.S. Cl. ..... 428/32.18; 428/32.21; 347/101; 347/105; 347/106; 162/134

(58) Field of Classification Search ..... 428/32.18, 428/32.21; 347/101, 106, 105; 162/134
See application file for complete search history.

(56) References Cited

U.S. PATENT DOCUMENTS

| | | | | |
|---|---|---|---|---|
| 2,038,679 A | | 4/1936 | Richter | |
| 4,671,691 A | | 6/1987 | Case et al. | |
| 4,758,461 A | | 7/1988 | Akiya et al. | |
| 5,853,901 A | | 12/1998 | Cessna | |
| 6,000,794 A | | 12/1999 | Kondo et al. | |
| 6,103,364 A | * | 8/2000 | Harris et al. | 428/326 |
| 6,133,170 A | | 10/2000 | Suenaga et al. | |
| 6,165,606 A | | 12/2000 | Kasahara et al. | |

FOREIGN PATENT DOCUMENTS

| | | |
|---|---|---|
| JP | 6-200484 | 7/1994 |
| JP | 8-13358 | 1/1996 |
| JP | 10-219588 | 8/1998 |
| JP | 10-245792 | 9/1998 |
| JP | 11-34481 | 2/1999 |
| JP | 11-34484 | 2/1999 |
| WO | 99/00541 | 1/1999 |

OTHER PUBLICATIONS

Database WPI, Derwent Publication, AN 1995-291096, JP 07 189168 A, Jul. 25, 1995.

* cited by examiner

*Primary Examiner*—Betelhem Shewareged
(74) *Attorney, Agent, or Firm*—Wenderoth, Lind & Ponack, L.L.P.

(57) ABSTRACT

An ink jet recording paper capable of compatible with high speed ink jet printers is provided. By using, as a fiber material, mercerized pulp obtained by applying an alkali treatment to pulp, an ink jet recording paper of high ink absorption speed and high ink coloring density is formed. Since the paper itself has excellent ink absorption speed, there is no requirement for applying coating for improving the ink absorption and it can be used as non-coated type ink jet recording paper.

2 Claims, No Drawings

INK JET RECORDING PAPER

This is a divisional of Ser. No. 09/673,217 filed Oct. 13, 2000, now abandoned, which is a 371 of PCT/JP00/01055, filed Feb. 24, 2000.

TECHNICAL FIELD

This invention concerns ink jet recording paper and, more specifically, it relates to ink jet recording paper having a high ink absorption speed compatible with high speed ink jet printers and high ink coloring density.

BACKGROUND ART

An ink jet recording system is a system of forming fine liquid droplets using an aqueous ink and blowing them to a recording medium by various methods to form images. Demand for the ink jet recording system has been increased remarkably in recent years because it does not result in unpleasant odor of an organic solvent due to the use of an aqueous ink, generates less noises and requires low running cost. Particularly, since color printing can be conducted easily in homes, simple printing at a personal level including printing for new year's cards is enabled.

However, the ink jet recording system involves a significant drawback when adopted industrially in that a printing speed is limited. That is, for attaining high speed color printing, a plurality kinds of inks have to be absorbed instantly after the inks have been blown to the recording medium. When the absorbing speed is low, blotting may occur or succeeding ink is blown and mixed before the ink blown precedingly has been absorbed, failing to obtain clear coloring.

In order to improve the ink absorption speed, various proposals have been made for recording paper in which a water absorbing substance is mixed in a coated layer. For example, Japanese Patent Laid-Open No. 34481/1999 discloses recording paper using gelatin material as a binder in a coated layer and Japanese Patent Laid-Open No. 34484/1999 discloses a recording material using a filler of good ink absorption.

However, when the paper is produced by such a coating system, the cost is inevitably increased. Accordingly, for producing high performance ink jet recording paper at a reduced cost, a non-coated type recording paper that can be manufactured in one step not by way of a coating step is desirable.

The non-coated type recording paper is generally marketed as wood free paper type or common paper type. In ink jet recording paper of marketed common paper type, an excessive sizing agent is incorporated in order to overcome spread of letters upon letter printing, which lowers the ink absorption speed. Such recording paper can provide a sufficient performance when used in printing only for the letters by a high speed ink jet printer, but images are blotted failing to obtain clear images when conducting multi-color printing.

DISCLOSURE OF INVENTION

In view of the above, this invention has been accomplished with an aim of providing ink jet recording paper having a high ink absorption speed compatible with high speed ink jet printers and giving high ink coloring density.

The present inventors have made an earnest study on the material used for the ink jet recording paper and, as a result, have found that an ink jet recording paper having high ink absorption speed and high coloring density can be obtained by using certain type of pulp as the fiber material for the paper.

That is, the ink jet recording paper according to this invention is characterized by using mercerized pulp as the fiber material.

In this invention, the mercerized pulp may be used alone as the fiber material for the paper, or the mercerized pulp may be used in admixture with other pulp.

The mercerized pulp used in this invention means pulp prepared by immersing pulp obtained by a usual bleaching method such as a kraft pulping or sulfite pulping method in a strong alkali solution and then thoroughly washing the same with water for removing residual alkali. It has been known that such mercerized pulp develops characteristics such as increase in the hygroscopic amount and increase in the strength of short fibers because of leaching of hemi-cellulose in the cellulose pulp. Further, since most of hydroxyl groups in the cellulose are substituted with sodium by the alkali treatment, fibers are less hydrogen bonded and, as a result, paper using the mercerized pulp forms bulky and low density paper.

However, it has not been reported so far at all that the paper using such mercerized pulp has a high ink absorption speed compatible with high speed ink jet printers and that the paper can be used as ink jet recording paper having high ink coloring density.

The ink jet recording paper according to this invention has no requirement of applying coating for improving the ink absorption since the paper itself has excellent ink absorption speed and can be used as non-coated type ink jet recording paper. However, coating may be applied optionally to such an extent as not hindering the ink absorption of paper itself.

BEST MODE FOR CARRYING OUT THE INVENTION

For the material of the mercerized pulp used in this invention, all materials for pulp including hardwood or softwood material or non-wood material can be used with no particular restriction. As specific pulp materials, those generally used as paper making fibers including hardwood unbleached kraft pulp (LUKP), hardwood bleached kraft pulp (LBKP), softwood unbleached kraft pulp (NUKP), softwood breached kraft pulp (NBKP), softwood bleached sulfite pulp (NBSP), thermomechanical pulp (TMP), linen pulp, bamboo pulp, straw pulp, kenaf pulp and the like can be used alone or as a mixture of them.

In this invention, use of the mercerized pulp as the fiber material for the paper is essential and the ratio of use thereof is from 10 to 100% by weight based on the entire fiber material. That is, the mercerized pulp may be used alone or the mercerized pulp may be used in admixture with non-mercerized pulp (not alkali treated pulp). In the case of mixed use, the ratio of using the mercerized pulp is 10% by weight or more in the entire fiber material. As the material for the non-mercerized pulp, one or more of the pulp materials described above can be blended for use and, in addition, synthetic fibers such as synthetic pulps, rayon, vinylon, nylon, polyester and the like can also be used optionally.

Further, for improving the ink jet recording adaptability of the paper such as ink coloring or ink absorption, known inorganic materials or organic materials conventionally used in the ink jet recording paper can optionally be used. Specifically, as the inorganic material, precipitated calcium carbonate, heavy calcium carbonate, kaolin, talc, calcium sulfate, barium sulfate, titanium oxide, zinc oxide, zinc sulfide, zinc carbonate, satin white, aluminum silicate, magnesium silicate, synthetic amorphous silica, silica sol, colloidal silica, alumina sol, colloidal alumina, boehmite, pseudo boehmite, aluminum hydroxide, aluminum and the like can be used. On the other hand, the organic material can include, for example, PVA, gelatin, glue, polyvinyl pyrrolidone, water soluble cellulose derivative, styrene/butadient copolymer, water-proof water soluble polymer, methyl methacrylate/butadiene copolymer and the like.

As the method of using the inorganic material and organic material described above, an internal addition method of making paper by mixing the same to the fiber material before paper making, a method of mixing with a size press solution during paper making process and coating on the paper or a method of coating by a coating machine after paper making can be adopted. It should avoid such a formulation as extremely lowering the ink absorption speed of the paper in the case of adopting any method and using any material. That is, when a coating solution, to which a binder or the like is blended in excess, is coated on the surface of the paper, the ink absorption speed is lowered to result in blotting at a place where inks are blown in stack. Further, since it is desirable for a non-coated type paper that can be manufactured in one step in view of the cost, it is preferred to adopt the internal addition method or the method of mixing with a size press solution and coating on the paper.

Further, a sizing agent or wax may be added into the fiber material optionally in order to reduce the spread of letters upon letter printing, but it should not be added to such an amount as hindering the ink absorption of the paper. This is because clear images can no more be obtained in a case of excess addition since the succeeding ink flies to the recording paper before the previous printed ink is dried, and these inks are mixed.

Furthermore, in addition to the materials described above, a fluorescent whitener for making the printing finishing satisfactory or an antistatic agent for preventing generation of static electricity upon sheet feeding can also be used.

Since the inks used in the ink jet printers are generally water soluble inks, paper having a property of absorbing water at high speed may be used as the paper having a high speed absorption for ink jet printer ink.

As an index for representing the water absorbing speed of paper, degree of size defined in JIS P 8122 (test method for Stöckgt sizing of paper) has been known and it is generally desired that the ink jet recording paper has a degree of size of 5 sec or less.

As another index for representing the paper water absorbing speed, there can be mentioned "Method for Determining the Liquid Absorbability of Paper and Board (Bristow's Method)" according to J. Tappi No. 51-87. The Bristow's method is a method adopted frequently as a method of evaluating the high speed absorption of paper in a short period of time, which is known as a particularly suitable method of evaluating the absorbability of paper with weak size. When the water absorbing speed of the ink jet recording paper according to this invention is evaluated by the Bristow's method, the liquid transfer length is found to be 100 mm or less when distilled water has been set at 50 μL in a head box of 1 mm slit width and 15 mm slit length and the moving speed of a test specimen has been set to 5.0 mm/sec, and the ink jet recording paper according to this invention shows excellent water absorbing speed compared with common paper or paper used exclusively for ink jet recording paper marketed at present.

The result of evaluating the coloring density and the water absorbing speed of the ink is shown below referring to examples of this invention and comparative examples, wherein "parts" and "%" mean parts by weight and % by weight.

<Evaluation for Coloring Density (1)>

Handmade paper obtained in the Examples 1 and 2, and Comparative Examples 1 and 2 described below were applied with solid printing by each of mono-color inks of cyan, magenta and yellow ("BCI-21 Color", manufactured by Canon Inc.) and Black ("BCI-21 Black", manufactured by Canon Inc.), respectively, by using an ink jet printer ("BJC-420" manufactured by Canon Inc.), and the results of measuring the coloring density using a densitometer ("MODEL No. 1155" manufactured by Macbeth Co.) are shown in Table 1.

EXAMPLE 1

LBKP of hardwood material was used and the pulp was dispersed into an aqueous 10% solution of sodium hydroxide to a pulp concentration of 5%, and then immersed at 20° C. for one hour to apply an alkali treatment to prepare mercerized pulp. Handmade paper of 100 g/m$^2$ was prepared by using the pulp.

EXAMPLE 2

The mercerized pulp prepared in Example 1 was beaten so as to be 400 mL (milliliter) C. S. F. and handmade paper of 100 g/m$^2$ was prepared by using the pulp.

COMPARATIVE EXAMPLE 1

LBKP of hardwood material used in Example 1 was used as it was without alkali treatment to prepare handmade paper of 100 g/m$^2$.

COMPARATIVE EXAMPLE 2

The pulp used in Comparative Example 1 was beaten so as to be 400 mL C. S. F. and handmade paper of 100 g/m$^2$ was prepared by using the pulp.

TABLE 1

| | Hardwood material (LBKP) | | Cyan | Magenta | Yellow | Black |
|---|---|---|---|---|---|---|
| Example 1 | Alkali treated | Not beaten | 1.32 | 1.42 | 1.27 | 1.23 |
| Comp. Example 1 | Not treated | Not beaten | 1.17 | 1.19 | 1.14 | 1.10 |
| Example 2 | Alkali treated | 400 mL C.S.F. | 1.30 | 1.29 | 1.23 | 1.20 |
| Comp. Example 2 | Not treated | 400 mL C.S.F. | 1.22 | 1.21 | 1.12 | 1.15 |

<Evaluation for Coloring Density (2)>

Handmade paper obtained in Examples 3 and 4, and Comparative Examples 3 and 4 described below were applied with solid printing by using an ink jet printer in the same manner as in the evaluation for coloring density (1), and the results of measuring the coloring density are shown in Table 2.

EXAMPLE 3

LBKP of hardwood material was used and the pulp was dispersed into an aqueous 10% solution of sodium hydroxide to a pulp concentration of 5%, and then immersed at 20° C. for two hours to apply an alkali treatment to prepare mercerized pulp. Handmade paper of 100 g/m2 was prepared by using the pulp.

COMPARATIVE EXAMPLE 4

The pulp prepared in Comparative Example 3 was beaten so as to be 400 mL C. S. F. and handmade paper of 100 g/m2 was prepared by using the pulp.

COMPARATIVE EXAMPLE 3

LBKP of hardwood material used in Example 3 was used as it was without alkali treatment to prepare handmade paper of 100 g/m2.

COMPARATIVE EXAMPLE 4

The mercerized pulp used in Comparative Example 3 was beaten so as to be 400 mL C. S. F. and handmade paper of 100 g/m$^2$ was prepared by using the pulp.

TABLE 2

| | Hardwood material (LBKP) | | Cyan | Magenta | Yellow | Black |
|---|---|---|---|---|---|---|
| Example 3 | Alkali treated | Not beaten | 1.30 | 1.45 | 1.27 | 1.23 |
| Comp. Example 3 | Not treated | Not beaten | 1.18 | 1.23 | 1.11 | 1.11 |
| Example 4 | Alkali treated | 400 mL C.S.F. | 1.29 | 1.32 | 1.22 | 1.19 |
| Comp. Example 4 | Not treated | 400 mL C.S.F. | 1.23 | 1.25 | 1.14 | 1.17 |

<Evaluation for Coloring Density (3)>

Handmade paper obtained in Examples 5 and 6, and Comparative Examples 5 and 6 described below were applied with solid printing by using an ink jet printer in the same manner as in the evaluation for coloring density (1), and the results of measuring the coloring density are shown in Table 3.

EXAMPLE 5

NBSP of softwood material was used and the pulp was dispersed into an aqueous 10% solution of sodium hydroxide to a pulp concentration of 5%, and then immersed at 20° C. for two hours to apply an alkali treatment to prepare mercerized pulp. Handmade paper of 100 g/m$^2$ was prepared by using the pulp.

EXAMPLE 6

The mercerized pulp prepared in Example 5 was beaten so as to be 400 mL C. S. F. and handmade paper was 100 g/m2 was prepared by using the pulp

COMPARATIVE EXAMPLE 5

NBSP of softwood material used in Example 5 was used as it was without alkali treatment to prepare handmade paper of 100 g/m2.

COMPARATIVE EXAMPLE 6

The pulp used in Comparative Example 5 was beaten so as to be 400 mL C. S. F. and handmade paper of 100 g/m2 was prepared by using the pulp.

TABLE 3

| | Softwood material (NBSP) | | Cyan | Magenta | Yellow | Black |
|---|---|---|---|---|---|---|
| Example 5 | Alakali treated | Not beaten | 1.41 | 1.52 | 1.34 | 1.28 |
| Comp. Example 5 | Not treated | Not beaten | 1.21 | 1.20 | 1.15 | 1.10 |
| Example 6 | Alkali treated | 400 mL C.S.F. | 1.32 | 1.33 | 1.27 | 1.21 |
| Comp. Example 6 | Not treated | 400 mL C.S.F. | 1.26 | 1.25 | 1.19 | 1.16 |

<Evaluation for Water Absorbing Speed>

Water absorbing speed was evaluated for the paper obtained in the following Examples 7 and 8 and Comparative Examples 7 and 8, using the liquid transfer length obtained by "Bristow's Method" (J. Tappi No. 51-87) as the index for representing the water absorbing speed. In this test method, a head box supplied with a known amount of liquid is brought into contact with a test specimen (paper) under movement at an arbitrary constant speed, the liquid is completely absorbed through the slit of the head box to a paper surface and the length of the transfer trace (mm) left by the liquid till all the liquid is transferred to the paper surface is measured. As the length is shorter, the liquid absorption of paper is better. As a measuring instrument, a dynamic permeation tester (manufactured by Toyo Seiki Seisakusho Co.) was used, in which 50 μL of distilled water (dye for providing distilled water with visible effect was mixed within such a range of concentration as giving no effect on the angle of contact of distilled water (0.1%)) was supplied to the head box of 1 mm slit width and 15 mm slit length, and the liquid transfer length (mm) was measured when setting the moving speed of the test specimen to 2.5, 5.0, 12.5 and 25.0 mm/sec respectively. The results of measurement are shown in Table 4.

EXAMPLE 7

30 parts by weight of marketed mercerized pulp ("SULFATATE HJ", manufactured by Rayonier Co. in USA), 40 parts of NBKP not alkali treated and 30 parts by weight of LBKP not alkali treated were mixed and the pulp mixture was beaten to a beating degree of 500 mL C. S. F. and paper of 80 g/m$^2$ was made by an ordinary method in a Fourdrinier paper machine.

EXAMPLE 8

45 parts by weight of marketed mercerized pulp ("SULFATATE HJ"), 35 parts of NBKP not alkali treated and 20 parts by weight of LBKP not alkali treated were mixed and the pulp mixture was beaten to a beating degree of 500 mL C. S. F. and paper of 80 g/m$^2$ was made by an ordinary method in a Fourdrinier paper machine.

COMPARATIVE EXAMPLE 7

As common paper for use in ink jet recording, marketed wood free common paper ("KA4250NP", manufactured by Seiko-Epson Co.) was used.

COMPARATIVE EXAMPLE 8

As paper of good absorption used exclusively for ink jet recording, marketed super fine exclusive use paper ("MJA4SP1", manufactured by Seiko-Epson Co.) was used.

TABLE 4

| | 2.5 mm/sec | 5.0 mm/sec | 12.5 mm/sec | 25.0 mm/sec |
|---|---|---|---|---|
| Example 7 | 35.5 | 49.0 | 63.0 | 91.0 |
| Example 8 | 27.5 | 32.5 | 42.0 | 54.0 |
| Comp. Example 7 | 335.0 | 391.5 | 443.5 | 459.0 |
| Comp. Example 8 | 106.0 | 112.5 | 125.5 | 132.0 |

From the results in Table 1 to Table 4, the followings were found.

(a) The paper according to this invention using the mercerized pulp formed by applying the alkali treatment to the pulp is improved with the coloring density of ink for use in ink jet printer compared with paper using non-mercerized pulp.

(b) Improvement of the ink coloring density is recognized for inks of all colors served for the test.

(c) Also in a case of using beaten pulp, paper using the mercerized pulp provided higher coloring density than that using the non-mercerized pulp.

(d) In a case of measuring the liquid transfer length when the moving speed of a test specimen is set to 2.5 to 25.0 mm/sec by "Bristow's Method" as defined in J. TAPPI No. 51-87, the paper according to this invention using the mercerized pulp shows the liquid transfer length of 100 mm or less at any moving speed and has excellent ink absorption speed compared with marketed ink jet recording paper.

INDUSTRIAL APPLICABILITY

As can be seen from the descriptions above, the ink jet recording paper according to this invention using the mercerized pulp as the fiber material can provide recording paper having high ink absorption speed compatible with high speed ink jet printers and exhibiting high ink coloring density.

Further, since the paper itself has excellent ink absorption speed, there is no requirement for applying coating for improving the ink absorption and the paper can be used as non-coated type ink jet recording paper.

The invention claimed is:

1. In a method for ink jet recording on paper with an ink jet printer, the improvement which comprises employing as said paper, a paper having a high ink coloring density and a high ink absorption speed, said paper consisting of 10 to 100% by weight of mercerized pulp based on an entire fiber material and 90 to 0% by weight of paper making pulp, having a liquid transfer length as defined in J. Tappi No. 51-87 of 100 mm or less, when distilled water has been set at 50 μL in a head box of 1 mm slit width and 15 mm slit length and the moving speed of a test specimen has been set to 5.0 mm/sec, said paper having no coating applied for improving ink absorption.

2. The method according to claim 1 wherein said paper making pulp is selected from the group consisting of hardwood unbleached kraft pulp, hardwood bleached kraft pulp, softwood unbleached kraft pulp, softwood bleached kraft pulp, softwood bleached sulfite pulp, thermomechanical pulp, linen pulp, bamboo pulp, straw pulp, kenaf pulp and a mixture of them.

* * * * *